US009215908B1

(12) United States Patent
Malmoux

(10) Patent No.: US 9,215,908 B1
(45) Date of Patent: Dec. 22, 2015

(54) FOOT BED

(75) Inventor: Ludovic Christian Malmoux, Malibu, CA (US)

(73) Assignee: OTZ SHOES, INC., Westlake Village, CA (US)

( * ) Notice: Subject to any disclaimer, the term of this patent is extended or adjusted under 35 U.S.C. 154(b) by 272 days.

(21) Appl. No.: 13/530,871

(22) Filed: Jun. 22, 2012

Related U.S. Application Data

(60) Provisional application No. 61/570,134, filed on Dec. 13, 2011.

(51) Int. Cl.

| | |
|---|---|
| ***A43B 13/38*** | (2006.01) |
| ***A43B 19/00*** | (2006.01) |
| ***A43B 13/16*** | (2006.01) |
| ***A43B 17/10*** | (2006.01) |
| ***A43B 17/02*** | (2006.01) |
| ***A43B 17/00*** | (2006.01) |

(52) U.S. Cl.
CPC ..... *A43B 13/386* (2013.01); *A43B 13/16* (2013.01); *A43B 17/003* (2013.01); *A43B 17/006* (2013.01); *A43B 17/02* (2013.01); *A43B 17/10* (2013.01)

(58) Field of Classification Search
CPC .... A43B 17/00; A43B 17/003; A43B 17/006; A43B 13/16; A43B 13/383; A43B 13/386; A43B 17/08; A43B 13/12; A43B 13/122; A43B 13/125; A43B 13/127; A43B 17/10; A43B 17/02
USPC ..... 36/43, 44, 71
See application file for complete search history.

(56) References Cited

U.S. PATENT DOCUMENTS

| | | | | |
|---|---|---|---|---|
| 2,838,776 | A * | 6/1958 | Tax | 12/142 N |
| 4,813,157 | A * | 3/1989 | Boisvert et al. | 36/44 |
| 4,831,750 | A * | 5/1989 | Muller | 36/28 |
| 5,150,536 | A * | 9/1992 | Strong | 36/7.1 R |
| 5,555,584 | A * | 9/1996 | Moore et al. | 12/142 N |
| 5,901,394 | A * | 5/1999 | Greenawalt | 12/142 N |
| 2005/0166425 | A1* | 8/2005 | Seiter | 36/44 |
| 2007/0011911 | A1* | 1/2007 | Clark et al. | 36/50.1 |
| 2008/0271340 | A1* | 11/2008 | Grisoni et al. | 36/43 |
| 2009/0193683 | A1* | 8/2009 | Igdari | 36/91 |
| 2010/0122475 | A1* | 5/2010 | Purrington et al. | 36/3 B |

* cited by examiner

*Primary Examiner* — Jila M Mohandesi
*Assistant Examiner* — Katharine Gracz
(74) *Attorney, Agent, or Firm* — Plager Schack LLP

(57) ABSTRACT

A foot bed comprises a bottom encasing mechanically coupled to a cushion. The cushion is mechanically coupled to an encasing sheet. The encasing sheet is mechanically coupled to a top cover.

1 Claim, 1 Drawing Sheet

FOOT BED

CROSS REFERENCE TO RELATED APPLICATIONS

This application claims priority to U.S. Provisional Application No. 61/570,134 filed on Dec. 13, 2011.

FIELD OF THE INVENTION

This invention relates to footwear. In particular, products in which a cushioning means is so positioned, or so constructed, that when applied to footwear, it provides a resilient support between the heel of the wearer and the heel seat surface of the footwear.

BACKGROUND OF THE INVENTION

Existing shoe insoles offer theories of how to provide comfort to feet or theories of how to remove odor from feet. However, none offer effective theories on both and none use the materials disclosed here to accomplish this dual purpose. For example, U.S. Patent Application 2011/0067272 by Lin teaches a foot bed made of strings to reduce odor. U.S. Patent Application 2008/0307679 by Chaing teaches a series of pillars designed to increase ventilation and thus decrease odor in a foot bed. All of these teach away from the present invention disclosed below.

BRIEF SUMMARY OF THE INVENTION

An improved foot bed comprises an uninterrupted continuous bottom encasing directly against an uninterrupted continuous cushion. The bottom casing completely surrounds and extends above a cushion perimeter of the uninterrupted continuous cushion. The uninterrupted continuous bottom encasing is thicker at the heel region than the toe region forming a continuous wedge. The cushion is joined to an uninterrupted continuous encasing sheet with cement. An encasing sheet perimeter is completely surrounded by and adjacent to the uninterrupted continuous bottom encasing which extends above the encasing sheet perimeter. The uninterrupted continuous encasing sheet is joined to a top cover and the uninterrupted continuous bottom encasing with cement. The top cover completely covers the e uninterrupted continuous encasing sheet and top edges of the bottom encasing. The uninterrupted continuous bottom encasing, the uninterrupted continuous cushion, the uninterrupted continuous encasing sheet and the top cover continuously run from heel to toe and each comprise: a heel-cup, an arch support and a metatarsal support.

BRIEF DESCRIPTION OF THE SEVERAL VIEWS OF THE DRAWINGS

Figure 1:
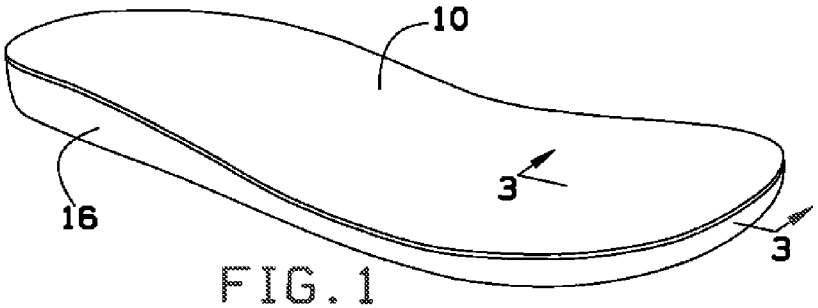

Having thus described the invention in general terms, reference will now be made to the accompanying drawings, which are not necessarily drawn to scale, and wherein:

FIG. 1 is a perspective view of the invention.

Figure 2:
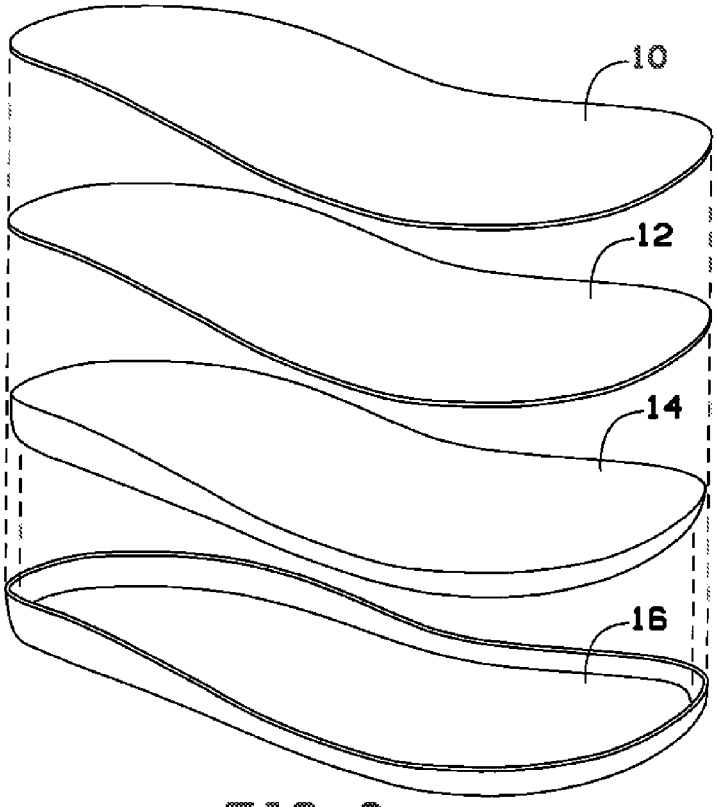

FIG. 2 is an exploded view of the invention.

Figure 3:
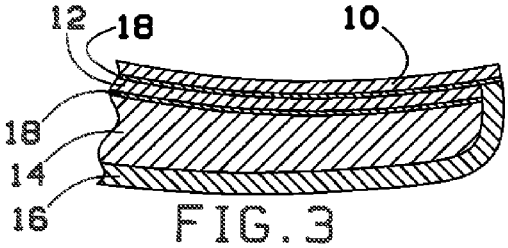

FIG. 3 is a partial section view of the invention taken about line 3-3 in FIG. 1.

DETAILED DESCRIPTION OF THE INVENTION

Embodiments of the present invention overcome many of the obstacles associated with comfort and smell of foot beds, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the improved foot bed in use. Once assembled, a user sees bottom encasing 16 is mechanically coupled to top cover 10 as discussed in FIG. 2.

FIG. 2 shows an assembly view of the improved foot bed. Bottom encasing 16 is mechanically coupled to cushion 14. Cushion 14 is mechanically coupled to encasing sheet 12. Encasing sheet 12 is mechanically coupled to top cover 10.

In some embodiments, bottom encasing 16 is made of cork. Cushion 14 is made from an ethylene vinyl acetate (EVA) foam. Encasing sheet 12 is made of cork. Top layer 10 is made of suede. In this manner, the cork has anti-microbial properties (reducing bacterial build-up which creates foot odor). The suede covering provides a soft feeling to the foot bed. It is important to use both of these together.

Cork foot beds alone while controlling odor tend to be quite hard. An EVA alone foot bed tends to produce odor after use. The cork also reduces heat from the EVA. In this manner, the improved foot bed provides comfort while controlling odor.

FIG. 3 provides a section view of the improved foot bed. To make the invention a user must first make a female mold and male mold. Next, a rectangular piece of EVA is cut into a wedge (because the section of the improved foot bed nearest the heel is thicker that the section of the improved foot bed nearest the toes), then the wedge is die cut creating an EVA blank that approximates the volume needed for the mold. Next, a cork veneer is placed over the female mold and the EVA blank placed on top. Using heat and compression these are then compressed together forming an ergonomic shape i.e., there is a heel-cup, arch support and metatarsal support. In this manner bottom encasing 16 is mechanically coupled to cushion 14. Next, encasing sheet 12 is mechanically coupled to cushion 14 by cement 18. Last, top cover 10 mechanically coupled to the now cork encased EVA foot bed with cement 18.

That which is claimed:

1. A foot bed, configured to reduce bacteria buildup while providing a soft feeling on a foot of a human user; the foot bed consists of:

an uninterrupted continuous bottom encasing made from cork; wherein the bottom encasing extends from a heel region to a toe region wherein the bottom encasing is thicker at the heel region than the toe region forming a continuous wedge; wherein the bottom encasing has anti-microbial properties of reducing bacterial build-up which creates foot odor;

an uninterrupted continuous cushion, pressed against the bottom encasing and surrounded on a cushion perimeter and bottom by the bottom encasing; wherein the cushion extends from a heel region to a toe region wherein the cushion is thicker at the heel region than the toe region forming a second wedge; wherein the cushion is made from an ethylene vinyl acetate foam; wherein the cushion provides the soft feeling on the foot of the human user;

an uninterrupted continuous encasing sheet, cemented to the cushion; and surrounded on an encasing sheet perimeter by the bottom encasing; wherein the encasing sheet is made from cork;

an uninterrupted continuous top cover, cemented to and covering both the encasing sheet and an upper perimeter of the bottom encasing; wherein the top cover is made from suede;

wherein the bottom encasing, the cushion, the encasing sheet and the top cover each comprise: a heel-cup, an arch support and a metatarsal support.

* * * * *